US005769532A

United States Patent [19]

Sasaki

[11] Patent Number: 5,769,532

[45] Date of Patent: Jun. 23, 1998

[54] SIGNAL WARNING AND DISPLAYING LAMP

[75] Inventor: Hiroki Sasaki, Ikoma, Japan

[73] Assignee: Patlite Corporation, Osaka, Japan

[21] Appl. No.: 764,045

[22] Filed: Dec. 12, 1996

[30] Foreign Application Priority Data

Dec. 15, 1995 [JP] Japan ..... 7-347613

[51] Int. Cl.[6] ..... F21V 13/08

[52] U.S. Cl. ..... 362/237; 362/247; 362/241; 362/800; 362/307

[58] Field of Search ..... 362/800, 241, 362/247, 249, 363, 355, 356, 351, 297, 346, 307, 311

[56] References Cited

U.S. PATENT DOCUMENTS 3,206,744 9/1965 Nelson ..... 362/247

5,642,933 7/1997 Hitora ..... 362/800

5,669,703 9/1997 Wheeler et al. ..... 362/800

5,688,042 11/1997 Madadi et al. ..... 362/800

*Primary Examiner*—Thomas M. Sember

*Attorney, Agent, or Firm*—Koda & Androlia

[57] ABSTRACT

A signaling lamp including a hollow cylindrical supporting column made from a light-transmitting material which has a central portion bulged outwardly so that the interior surfaces are made into reflective surfaces. LEDs are arranged in rows so as to face each other above and below the reflective surfaces, and the supporting column and the LEDs are surrounded by a globe which has diffusing lenses. The light from the LEDs is reflected toward the circumference by the reflective surfaces and is projected into the surrounding area via the globe.

4 Claims, 3 Drawing Sheets

SIGNAL WARNING AND DISPLAYING LAMP

BACKGROUND OF THE INVENTION

1. Field of the Invention

The present invention relates to a signal warning and displaying lamp which uses LEDs as a light source and is designed so that signal light from the light source is diffused and projected into the surrounding area.

2. Prior Art

Many different types of signal warning and displaying lamps which use LEDs, or light-emitting diodes, as light sources have been placed on the market, and various designs have been employed in structural terms as well. The reason for this proliferation of lamps is that the use of LEDs as a light source makes the changing of light bulbs unnecessary. In addition, LEDs are also resistant to vibration, etc. Accordingly, a change-over from conventional incandescent bulb light sources to LED light sources is being sought.

However, the quantity of light emitted by LEDs is small. It is, accordingly, necessary to use some type of device so as to supplement this light quantity. Means which have been used, either singly or in combination, include increasing the number of LEDs used, increasing the brightness by using focusing type LEDs, and increasing the apparent size of the light source by using various types of lenses to diffuse the light.

One conventional example is disclosed in Japanese Utility Model Application Laid-Open Publication (Kokai) No. 62-78770.

In this device, LEDs are installed upright with a circumferential orientation, and the light of the light source is amplified by a drum-shaped reflecting member. As seen from this example, conventionally, LEDs are simply oriented toward the outer circumference of the lamp. When single LEDs are thus oriented toward the outer circumference, point-form light sources are seen by the observer; and in this device, since light from the light source is reflected and projected by the drum-shaped reflecting member, a linear light source is seen by the observer. In order to broaden the range of visibility and cause reflection and projection of the light-source light by the drum-shaped reflecting member, diffusion type LEDs are used. However, a drawback in this diffusion type LED device is that the signal light is diffused when the signal warning and displaying lamp is viewed from a distance. Thus, there are problems in terms of inferior visibility from a distance.

Another conventional example is disclosed in Japanese Utility Model Application Kokai No. 2-108806 which was filed previously by the applicant of this application.

In this case, signal light is obtained from a reflected LED light. The device is constructed so that focusing type LEDs are arranged in rows facing each other at the top and bottom of a supporting column which is installed in an upright position in the center of the signal warning and displaying lamp, and lights from these point-form light sources are reflected toward the circumference as a linear light by reflective surfaces formed on the supporting column. The light thus reflected passes through the diffusing tens of a globe consisting of a colored transparent material and is emitted into the surrounding area.

Thus, in this lamp, since a long distance can be insured between the LEDs and the lens of the globe, focusing type LEDs are used; and because of the focusing type LEDs, the size of the light source can be increased, and the overall size of the signal warning and displaying lamp can be reduced.

In the lamp described above, however, a vacuum evaporation treatment is ordinarily performed in order to improve the reflection efficiency of the reflective surfaces of the supporting column, using a metal that has a good reflectivity such as aluminum, etc. As a result of the vacuum evaporation treatment, parts tend to be expensive, and there is room for a further improvement in the reflectivity of the reflective surfaces.

SUMMARY OF THE INVENTION

Accordingly, the object of the present invention is to provide a signal warning and displaying lamp which offers improved visibility and can be manufactured at a low cost.

The object is accomplished by a unique structure for a signal warning and displaying lamp wherein: focusing type LEDs are arranged in rows so as to face each other at the top and bottom of a supporting column which is installed in an upright position in the center of a signal warning and displaying lamp; the light from these point-form light sources is converted into a linear light and reflected toward the circumference of the lamp by reflective surfaces formed on the supporting column so as to pass through the diffusing lens of a globe made of a colored transparent material so that the signal light is provided to the surrounding area as a planar light source; and in this structure, the supporting column is made from a light-transmitting material having an bulged central portion so that the interior surfaces of this bulged central portion are used as reflective surfaces of the light from the LEDs.

DETAILED DESCRIPTION OF THE PREFERRED EMBODIMENTS

Figure 1:
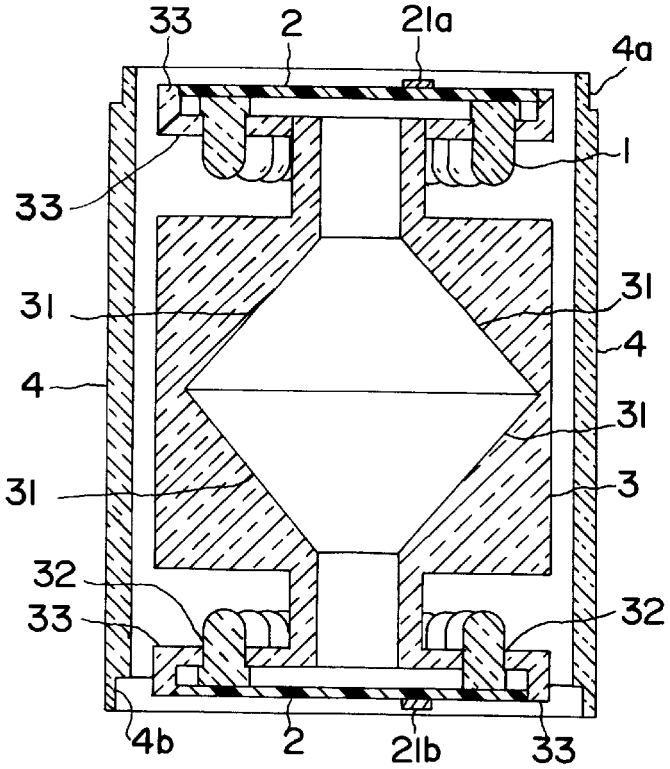
FIG. 1 is a sectional view of the essential portion of a signal warning and displaying lamp according to one embodiment of the present invention.

FIG. 1 shows the essential portion of the signal warning and displaying lamp according to one embodiment of the present invention.

The reference numeral 1 denotes LEDs which are held and wired on upper and lower substrates 2. These LEDs 1 are focusing type LEDs, and each has an approximately 5 degrees of diffusion angle. LEDs having a higher degree of diffusion angle can be used when it is desired to increase the visual angle of the light source. Holes (not shown) through which the wiring is passed are formed in the center of each one of the disk-form substrates 2, and a plurality of LEDs 1 are installed at equal intervals in a circumferential arrangement on each substrate 2. The upper and lower substrates 2 are respectively provided with connectors 21*a* and 21*b* which form a pair with each other, and these connectors 21*a* and 21*b* are used to connect a plurality of lamps in a vertical fashion as shown, for example, in FIG. 4 so as to form a multi-staged lamp.

A supporting column 3 is formed from a light-transmitting material, and a methacrylic resin is used in this embodiment.

This supporting column 3 has a shape of a hollow cylinder and has stands 33 formed integrally on the top and bottom of the column 3. Each stand 33 includes a plurality of LED holders 32 which are formed in a circumferential arrangement. The LEDs 1 and substrates 2 are mounted on the stands 33 so that respective LEDs 1 are inserted into the LED holder 32 of the stands 33. The LEDs 1 are held by the LED holders 32 with a slight clearance in between so that no fluctuation of the projection axes of the LEDs 1 will occur.

As long as the material of the above-described supporting column is a light-transmitting material, an appropriate lamp function is obtainable; and examples of materials which can be used include transparent synthetic resins such as methacrylic resins and AS resins, etc., and inorganic materials such as glass, etc.

Furthermore, the interior of the supporting column 3 is bulged outwardly as best seen in FIG. 1 so as to be a tubular form near the center of the column with respect to the vertical direction; as a result, reflective surfaces 31 with a horizontally oriented V shape ("<") are formed around the entire inner central circumference of the supporting column 3. Signal light from above is reflected horizontally outward by the upper side of the bulged ("<") surface, while signal light from below is reflected horizontally outward by the lower side of the bulged ("<") surface.

The above-described "inner-surface reflection" utilizes the total internal reflection of a perpendicular prism in order to bend the light. Accordingly, a reflectivity of close to 100% is obtained by the light which is incident at an angle greater than the critical angle. Prisms are most commonly employed as reflecting mirrors or optical elements which utilize the refractive properties of light in order bend the light. In the present invention, any other combination of prism structures or lenses utilizing total internal reflection may also be appropriately used.

More specifically, the horizontal surfaces at the top and bottom of the bulged portion of the supporting column 3 where the LED light enters, the cylindrical surface of the outer circumference of the bulged portion of the supporting column 3, and the reflective surfaces formed by the interior surfaces of the bulged portion can be formed not only as a smooth flat surface or a curved surface but also as a focusing lens surface or a diffusing lens surface. By utilizing such lens shapes when the supporting column 3 is created, various types of lens effects can be obtained.

As a first example, if the horizontal surfaces at the top and bottom of the bulged portion are formed in a focusing lens shape, and the inner reflective surfaces of the bulged portion are formed in a diffusing lens shape, then the visual angle of the signal warning and displaying lamp in the vertical direction will become narrow, but a signal light with high brightness will be obtained in the horizontal direction.

As a second example, if the horizontal surfaces at the top and bottom of the bulged portion are formed in a diffusing lens shape, and the cylindrical surface on the outer circumference of the bulged portion is formed as a combination of a focusing lens shape and a cylindrical surface, then the obtained effect will be that a strong signal light is emitted from the signal warning and displaying lamp in a specific desired direction, while at the same time the lamp is widely visible from other directions, both above and below and from the left and right.

In the present invention, such combinations of lens shapes can be obtained merely by forming the supporting column 3 in an appropriate manner, and no adjustment is required for the setting of the lenses and reflective surfaces. Various other lens combinations can be utilized in the present invention, so that different light-emitting characteristics depending upon the purposes of the signal warning and displaying lamp are obtainable.

Figure 3:
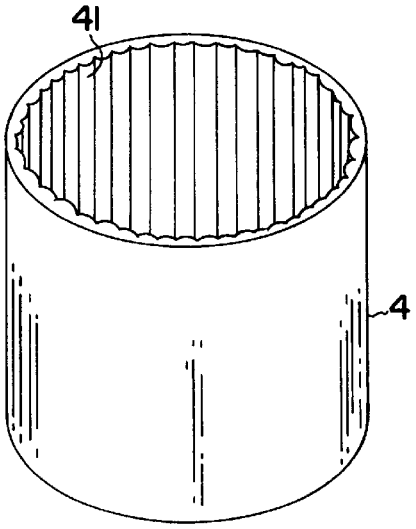
FIG. 3 is an external perspective view of the globe used in the lamp.

FIG. 3 shows an external perspective view of a globe used in the lamp of the present invention. This globe 4 has a cylindrical shape and is made of a colored transparent material. Vertical rib-form diffusing lenses 41 are formed on the inner surface of the globe 4; and these lenses 41 diffuse and project signal light from the LEDs 1 in the lateral direction.

In regard to the color of the globe 4, various different colors such as red, blue, yellow, green, etc. may be used in order to project colored signal light. The globe 4 can be transparent with or without any desired color.

As seen from FIG. 1, the globe 4 is formed with an upper outer step portion 4*a* and a lower inner step portion 4*b*. These step portions 4*a* and 4*b* formed at upper and lower ends of the globe 4, respectively, are used when a plurality of globes 4 are placed one on the other in the axial direction thereof as described below.

In regard to the diffusing lenses 41 of the globe 4, substantially the same effect can be obtained when globes with some other lens shape are used. For instance, vertical outside ribs can be formed on the globe 4, or polygonal ribs can be formed on the inner and/or outer side surface of the glove 4, as long as diffusion in the lateral direction can be achieved.

Figure 4:
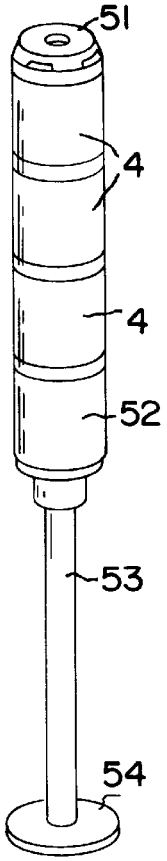
FIG. 4 is an external perspective view of the overall signal warning and displaying lamp.

The construction of the main components and light source elements of the signal warning and displaying lamp is as described above. FIG. 4 shows an overall view of the signal warning and displaying lamp used in a stacked fashion.

More specifically, a plurality of light source elements each consisting of supporting columns 3 and LEDs are stacked together in an axial direction of the columns 3 via the connectors 21*a* and 21*b*; and the globes 4 are also stacked in the axial direction thereof so as to surround the stacked light source elements. In this case, the upper outer step portion 4*a* of one globe 4 is engaged with the lower inside step potion 4*b* of another globe 4 placed thereon. In addition, a head cover 51 is mounted on the upper most globe 4, and a pole 53 is installed beneath a case 52 which accommodates a flashing circuit board, buzzer circuit board, etc. By installing a screw (not shown) through the head cover 51, the upper most globe 4 is pressed in the axial direction or downward in FIG. 4, and the stacked globes 4 and light source elements are secured in place. Attachment of the thus obtained lamp to other equipment is accomplished by the use of a bracket 54. The light sources of the respective stacked light source elements are lit and/or caused to flash in accordance with a predetermined setup, so that respective specified signals can be displayed by the emitted light (of different color).

Figure 5A:
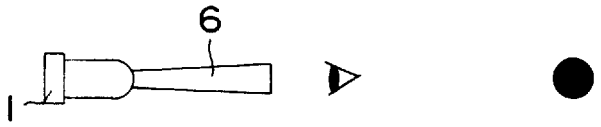
FIGS. 5(*a*), 5(*b*) and 5(*c*) are an explanatory diagrams illustrating the visibility of the light from the light source.
Figure 5B:
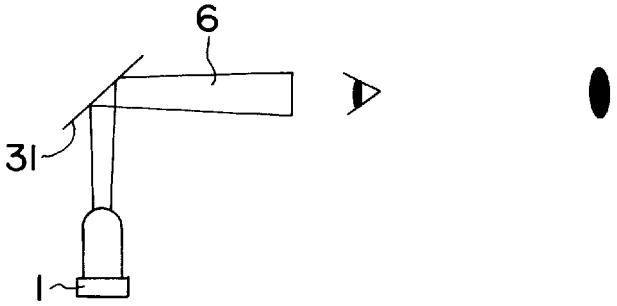
Figure 5C:
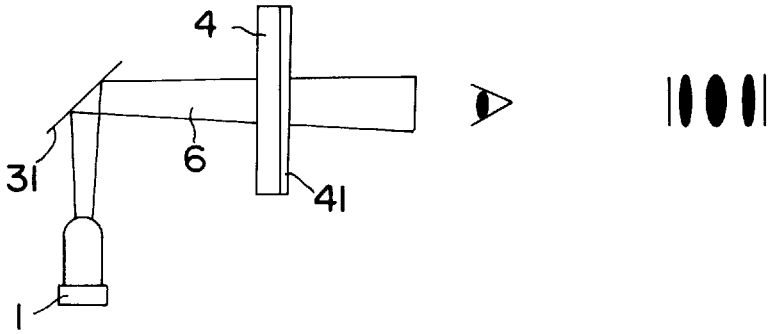

The manners of light projection from the LEDs and the visibility of the light to observers will be described below with reference to FIGS. 2 and 5.

First, the LEDs 1 are arranged in rows facing each other above and below as described with reference to FIG. 1. If these LEDs are observed "as is", the signal light 6 from the LEDs is observed in a form of large point-form light sources as shown in FIG. 5(*a*). With numerous LEDs installed as in the present invention, then numerous large point-form light sources are observed.

The signal light 6 is reflected and projected toward the circumference by the reflective surfaces 31. Since the reflective surfaces 31 are curved rather than flat, the signal light 6 is projected toward the circumference in a diffused fashion and seen as shown in FIG. 5(*b*). With numerous LEDs installed as in the present invention, numerous vertically oriented linear light sources lined up side by side are observed.

Finally, the signal light 6 passes through the diffusing lenses 41 of the globe 4 and is thus colored and projected. When the light passes through the globe 4, the light is further diffused and separated in the lateral direction by the diffusing lenses 41 as shown in FIG. 5(*c*). Thus, the lamp of the present invention which uses numerous LEDs provides the observers with an aggregation of the signal light 6 as a planar light. Furthermore, since the LED light from above and below is reflected and projected toward the circumference by the upper and lower sides of the reflective surfaces 31, the observed size of the light source is doubled in the vertical direction.

Figure 2:
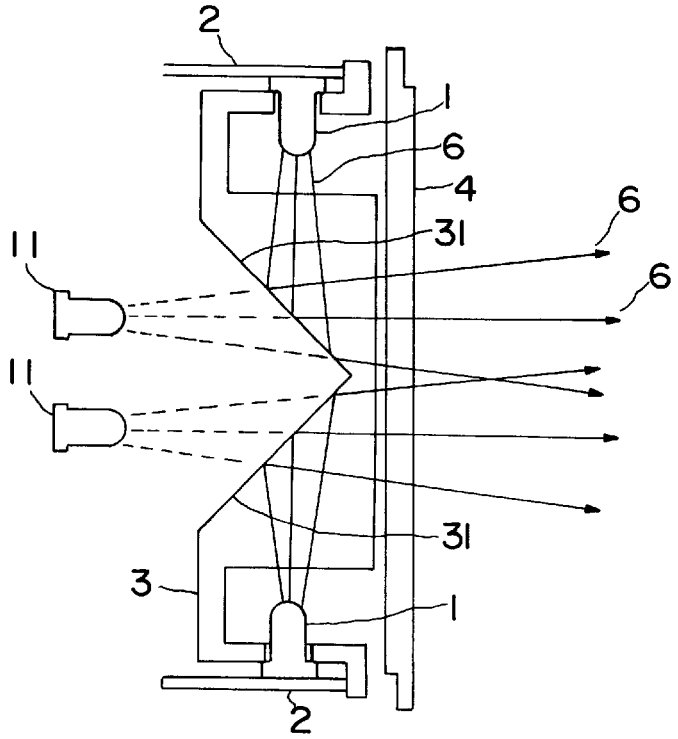
FIG. 2 is an explanatory diagram which illustrates the light projection from the signal warning and displaying lamp of the present invention.

As seen from FIG. 2, the individual light sources seen by the observer appear to be located at the positions illustrated by the dotted lines as imaginary light sources 11; as a result, a considerable distance is obtained between the imaginary light sources 11 and the diffusing lenses 41 of the globe 4. Accordingly, the light appears to be a planar light rather than point-form light as in a conventional LED type signal warning and displaying lamp, so that the visibility of the signal display is improved.

The present invention is not limited by the above description. For example, it is possible to divide the supporting column into a plurality of sections. In addition, the effect of the present invention can be achieved by the structure wherein the supporting column and upper and lower stands are formed separately, and the same is true for the structure that includes no stands. Furthermore, optimal LED light source units for a signal warning and displaying lamp can also be obtained by appropriately combining the reflective surfaces and lens shapes of the supporting column and globe even in cases where LEDs other than focusing type LEDs are used. Various other design modifications and applications to similar commercial products are within the scope of the present invention.

As seen from the above, according to the present invention which uses internal-surface reflection, a better reflection efficiency than conventional reflective surfaces that consist of vacuum evaporated metal coating films is obtainable. The reflectivity of a vacuum-evaporated aluminum film is approximately 90%, while the internal-surface reflectivity of a prism, which the present invention employs, is approximately 100%. Furthermore, the lamp of the present invention does not involve a column that needs a metal vacuum evaporation process, accordingly, the supporting column which constitutes the reflecting member of the present invention can be manufactured inexpensively.

In the present invention, furthermore, a considerable distance can be obtained between the LEDs and the lenses of the globe. Accordingly, even if focusing type LEDs are used, the size of the light source can be increased, the overall size of the signal warning and displaying lamp can be reduced, and a signal warning and displaying lamp with superior visibility can be obtained.

I claim:

1. A signal warning and displaying lamp characterized in that a hollow cylindrical supporting column consisting of a light-transmitting material is installed in an upright position in a center of said signal warning and displaying lamp, a central portion of said supporting column is expanded so that interior surfaces of said central portion are made into reflective surfaces, LEDs are arranged in rows so as to face each other above and below the column, signal light from above and below is reflected in a circumferential direction by said reflective surfaces, and said signal light passes through a diffusing lens of a globe which surrounds an entire lamp assembly and is displayed to a surrounding area.

2. A signal warning and displaying lamp comprising:

a hollow cylindrical column made of a light-transmitting material, an interior of said cylindrical column being provided with a bulged portion at substantially a center thereof with respect to an axis of said cylindrical column, thus forming reflective surfaces on said bulged portion;

stand means integrally formed at both ends of said cylindrical column, a plurality of LEDs provided circularly on each of said stand means so that light from said LEDs advances into said column from both ends of said cylindrical column and are reflected by said reflective surfaces of said bulged portion so as to advance outward of said cylindrical column; and a cylindrical globe means provided so as to surround at least said cylindrical column, said cylindrical globe being provided with a light diffusing means on a circumferential surface thereof.

3. A signal warning and displaying lamp according to claim 2, further comprising a connecting means provided on each of said stand means so that a plurality of said lamps are stacked together in a direction of the axis of said cylindrical column via said connecting means.

4. A signal warning and displaying lamp according to claim 2, wherein said LEDs are focusing type LEDs, each having a diffusion angle of approximately 5 degrees.

* * * * *